US005401540A

United States Patent [19]

Miles et al.

[11] Patent Number: 5,401,540

[45] Date of Patent: Mar. 28, 1995

[54] PRINTER SUPPORT BRUSH AND METHOD

[75] Inventors: Lawrence D. Miles, Nichols, N.Y.; Gary E. Welch, Towanda, Pa.

[73] Assignee: Masonite Corporation, Chicago, Ill.

[21] Appl. No.: 156,395

[22] Filed: Nov. 22, 1993

Related U.S. Application Data

[63] Continuation of Ser. No. 885,342, May 18, 1992, abandoned.

[51] Int. Cl.[6] ..... B05D 1/28

[52] U.S. Cl. ..... 427/428; 118/249; 271/272

[58] Field of Search ..... 118/249; 427/428; 271/272

[56] References Cited

U.S. PATENT DOCUMENTS

| | | | |
|---|---|---|---|
| 2,553 | 4/1842 | Gilbert | 118/249 |
| Re. 29,632 | 5/1978 | Tanaka et al. | 355/11 |
| 196,161 | 10/1877 | Morgenthau | 118/249 |
| 603,638 | 3/1898 | Hawthorn et al. . | |
| 771,544 | 10/1904 | Goldsmith . | |
| 1,114,893 | 10/1914 | Lerche . | |
| 2,263,131 | 11/1941 | Hoza | 118/249 |
| 2,700,953 | 2/1955 | Howe et al. | 118/249 |
| 2,874,675 | 2/1959 | Wakefield | 118/249 |

*Primary Examiner*—Shrive Beck
*Assistant Examiner*—Katherine A. Bareford
*Attorney, Agent, or Firm*—Marshall, O'Toole, Gerstein, Murray & Borun

[57] ABSTRACT

An apparatus and method for printing or coating material and supporting the material during printing or coating thereon by either offset-gravure or direct roll equipment includes a cylindrical support member having flexible bristles radiating therefrom. The bristles are of a suitable diameter, length and spacing to form a generally cylindrical brush that is oriented in spaced relation to a contact printing or coating roller and adapted to yield or bend when coming in contact with contoured or uneven portions of the material and thereby fully support the lower surface of the material as the upper surface of the material is being printed upon or coated.

12 Claims, 1 Drawing Sheet

Fig. 1
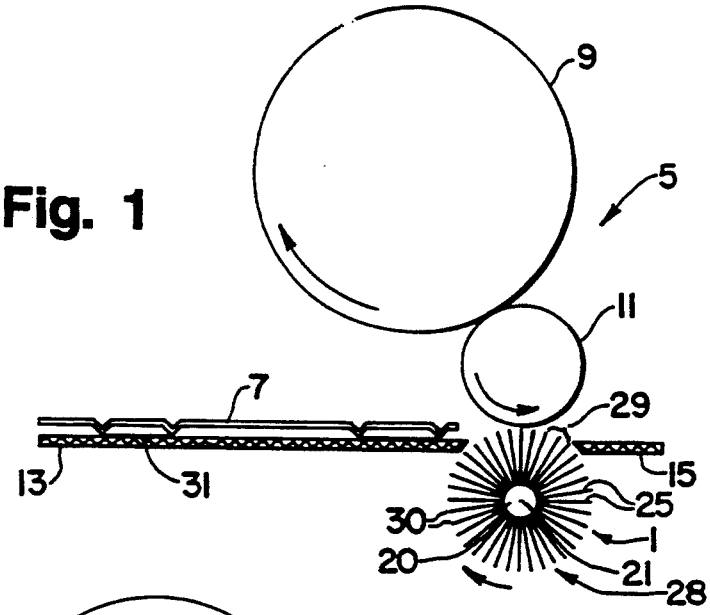
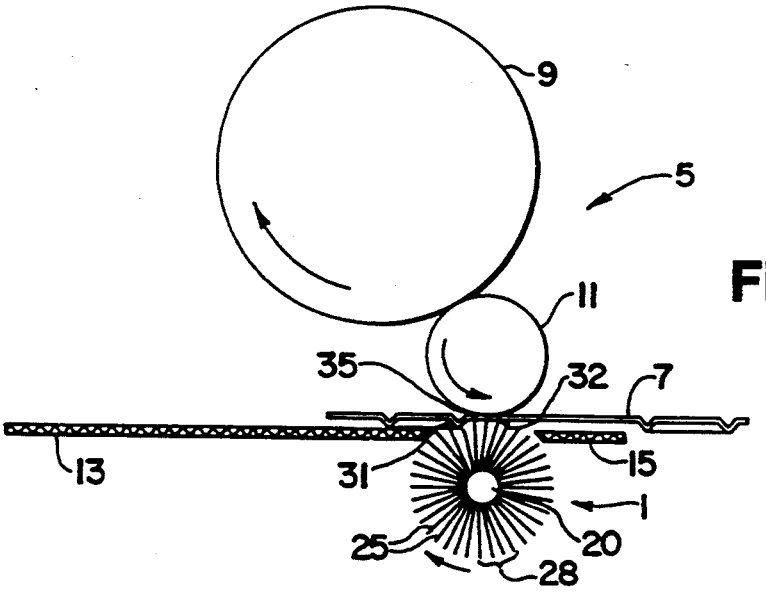
Fig. 2
Fig. 3
PRIOR ART
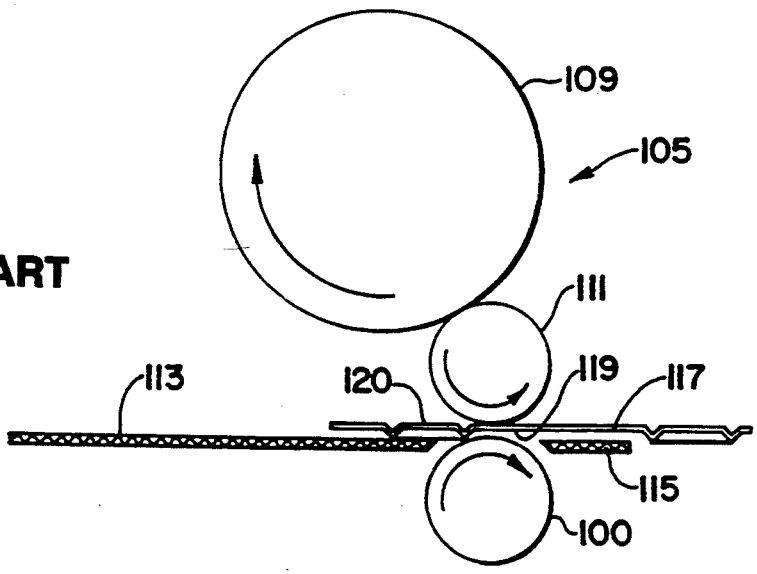

PRINTER SUPPORT BRUSH AND METHOD

This is a continuation of U.S. application Ser. No. 07/885,342, filed May 18, 1992, now abandoned.

BACKGROUND OF THE INVENTION

1. Field of the Invention

This invention relates to offset-gravure and direct roll printing and coating equipment and particularly to an apparatus and method for supporting material having at least one irregularly shaped surface during printing or coating of the material.

2. Description of Related Technology

Offset-gravure and direct roll coating machines usually include a metal support roller or rollers for bearing and conveying material, such as paper or panels, being printed upon or coated. The support roller is typically an elongate cylinder spaced beneath a printing or coating roller. The support roller rotates in a direction opposite to the direction of rotation of the printing or coating roller with the material to be coated or printed upon sandwiched therebetween. The material is held by friction between the two rollers with the lower support roller providing full support beneath the area of the material that is printed or coated, resulting in an even printing or coating.

When contoured or molded panels are conveyed through a conventional contact printing or coating machine, an unacceptable, non-uniformprinting or coating results because the rigid surface of the support roller does not come in contact with and support the entire lower surface of the material as the printing or coating roller presses against the upper surface of the material. Thus, conventional printing or coating machines are often ineffective for use on contoured panels unless special carrier panels are made to support the lower surface of the contoured panel during printing. This problem has also been solved by spray coating of contoured panels. These alternative printing and coating means require additional equipment, set-up time or both, resulting in additional printing or coating expense.

SUMMARY OF THE INVENTION

It is an object of the invention to overcome one or more of the problems described above.

According to the invention, an apparatus for suitably supporting material having an irregularly shaped surface during printing or direct surface coating thereon is provided wherein a conventional printing or coating machine includes a cylindrical support member having suitable yielding or flexible bristles radiating therefrom. The bristles are of a suitable diameter, length and spacing to fully support the material being conveyed through the printing or coating machine. The individual bristles flex or yield when contacted with the surface of the material but are of sufficient length and rigidity to hold the material to be printed against the printing or coating roller to ensure uniform printing or coating.

A method of printing or coating a material having an irregularly shaped surface is also provided that includes the steps of supporting the material with a flexible brush support mechanism according to the invention and printing or roll coating onto the material while it is being supported by the mechanism.

Other objects and advantages of the invention will be apparent to those skilled in the art from a review of the following detailed description, taken in conjunction with the drawings and the appended claims.

BRIEF DESCRIPTION OF THE DRAWINGS

FIG. 1 is a partially schematic and cross-sectional view of an offset-gravure printing apparatus including a printer support mechanism according to the invention shown with a contoured panel.

FIG. 2 is a partially schematic and cross-sectional view of the printing apparatus of FIG. 1 shown with a contoured panel being supported by the printer support mechanism.

FIG. 3 is a partially schematic and cross-sectional view of a conventional offset-gravure printing mechanism shown with a contoured panel.

DETAILED DESCRIPTION OF THE INVENTION

A printer support mechanism, generally designated 1, is shown in FIGS. 1 and 2. The support mechanism 1 is located within and rotatably attached to a coating or printing machine such as, for example, an offset-gravure printing apparatus, generally designated 5, for the coating or printing of a contoured panel 7 or other material having a thickness variation or irregularly shaped surface. The apparatus 5 includes an engraved roller 9, means for transfer of ink or other printing or coating material from the roller 9 to the panel 7 as illustrated by a transfer or contact member or roller 11, means for conveying the panel 7 to the transfer roller 11, such as illustrated by a conveyor 13 and means for conveying the panel 7 from the transfer roller 11 and out of the apparatus 5 such as illustrated by a conveyor 15.

Although an offset-gravure apparatus 5 is shown in the drawings, a support mechanism 1 of the invention may also be utilized with a direct roll printing or coating apparatus (not shown). For the sake of brevity, the apparatus and method of the present invention will hereafter be discussed in terms of "coating" of material, which is meant to include both mechanisms and methods of either contact "coating" or "printing" by either direct roll or offset-gravure means.

The printer support mechanism 1 includes a cylindrical core portion or member 20 that has an axis 21 that is located generally beneath and between the conveyors 13 and 15 and has a length approximately equal to the width of the conveyors 13 and 15. The cylindrical member 20 is rotatably mounted to a support structure (not shown) of the coating apparatus 5 and is positioned generally horizontally and perpendicular or transverse to the direction of travel of the panel 7 on the conveyors 13 and 15. The cylindrical member 20 is driven by an electric motor (not shown) or other driving or moving means connected to a power source (not shown) and is rotated about the axis 21 by the driving means in a direction opposite to the direction of rotation of the transfer roller 11 that is also rotatably mounted to the support structure of the coating apparatus 5.

The engraved roller 9 is also rotatably mounted to the support structure of the coating apparatus 5 and is adapted to contact and engage the transfer roller 11 and transfer ink or other coatings (not shown) from a dispenser (not shown) to the transfer roller 11. The engraved roller 9 is also driven by an electric motor (not shown) or other driving or moving means and is rotated thereby in the same direction as the cylindrical member 20.

A plurality of flexible bristles 25 are fixed to the cylindrical member 20 and extend radially from the axis 21 along the entire cylindrical surface of member 20, forming a generally cylindrical brush or bristle cylinder 28. The diameter and length of each bristle 25 is specifically fixed or set and the spacing between bristles 25 is set to form a brush surface 29 created by the bristle ends 30, that is in spaced relation to the outer surface of the transfer roller 11 and adapted for the conveyance of the panel 7 therebetween. The bristles 25 are also adapted to suitably yield or bend upon contact with a downwardly projecting portion 31 of the contoured panel 7 while supporting a straight or horizontal portion 32 of the panel 7 by bristle ends 30 that are not bent. The bristles 25 are flexible and are adapted to be in contact with and support the lower surface (both the projection 31 and straight portion 32), of the panel 7 as the corresponding upper surface 35 of the panel 7 is being coated.

Various brush materials and configurations may be utilized for the support mechanism. For example, a preferred support mechanism 1 for printing thirty inch wide panels (having a density of 50 lb/ft$^3$) on a printing apparatus capable of printing up to 48 inch wide panels has the dimensions and characteristics set forth in the table below:

| Nylon Bristle Support Mechanism | Dimensions (in inches) and Characteristics |
|---|---|
| Core Outer Diameter | 4.25 |
| Core Length | 50.5 |
| Brush Outer Diameter | 7.25 |
| Hair Face | 49.25 |
| Bristle Diameter | 0.025 |
| Configuration | fill fineset 3R60 dense |

From the above-described preferred support mechanism and the remainder of the disclosure, one skilled in the art may readily empirically determine the dimensions and characteristics required for a support mechanism that may be utilized for the coating of various materials and sizes thereof. The core length may be varied to correspond with the width of the panel or other material being coated. Otherwise, the core outer diameter, brush outer diameter, hair face, bristle diameter and brush configuration described above may be used with a variety of materials.

Materials less dense than 50 lb/ft$^3$ may be supported by a mechanism having bristles of a smaller diameter and brush configuration that is less dense than the preferred support mechanism described above. Likewise, for materials more dense than 50 lb/ft$^3$, a mechanism having bristles of a greater diameter, brush configuration more dense and a core diameter greater than the above-described preferred support mechanism may be desired.

In operation, the contoured panel 7 is first conveyed to the transfer roller 9 and printer support mechanism 1 by the conveyor 13 as shown in FIG. 1. Both the transfer roller 11 and the printer support mechanism 1 are rotated in a direction adapted to feed the panel 7 therebetween. As the panel 7 travels to a location near the transfer roller 9, the lower surface of the panel 7 contacts the bristles 25 of the mechanism 1. The rotating bristles 25 draw the panel 7 into the space between the transfer roller 11 and the printer support mechanism 1. As illustrated in FIG. 2, the bristles 25 yield or bend as portions of the panel 7 project downwardly as the panel 7 is pressed between the transfer roller 11 and the cylindrical brush 28 of the support mechanism 1. The coating or ink transferred to the transfer roller 11 by the rotating engraved roller 9 is evenly applied to the contoured panel 7 as the bristles 25 of the brush 28 stably support the lower surface of the contoured panel 7 and firmly press the panel 7 toward the transfer roller 11.

For comparison, FIG. 3 illustrates a traditional rigid metal support roller 100 mounted in a coating machine 105 having an engraved roller 109, a transfer roller 111 and conveyors 113 and 115 identical to the respective engraved roller 9, transfer roller 11 and conveyors 13 and 15 shown in FIGS. 1 and 2. A contoured panel 117 is shown sandwiched between the transfer roller 111 and the rigid support roller 100. However, the roller 100 does not support the entire lower surface 119, of the panel 117, leaving a gap or space between the panel 117 and the support roller 100. Thus, the top surface 120 of panel 117 is not pressed evenly against the transfer roller 11, resulting in uneven coating.

The support mechanism 1 may be used for the printing of flat panels as well as contoured panels. Flat panels often vary in thickness from area to area, providing an irregular surface for printing if a conventional rigid metal support roller is utilized in the printing apparatus. The flexible bristles 25 of the support mechanism 1 firmly press a flat panel toward the transfer roller 11 providing for uniform printing even if the panel thickness is irregular.

The foregoing description is given for clearness of understanding only, and no unnecessary limitations should be understood therefrom, as modifications within the scope of the invention will be apparent to those skilled in the art.

We claim:

1. In a method for printing or roll coating a material having a surface with at least one irregularly shaped surface portion and a substantially flat surface portion with a coating or transfer roller, at least a portion of the irregularly shaped surface portion projecting away from the coating or transfer roller, the improvement comprising the steps of:

(a) supporting the material with a flexible brush mechanism comprising a plurality of bristles having a diameter, length and spacing selected to yield or bend upon contact with the projecting portion of the irregularly shaped surface portion of the material while unbent bristles support the flat surface portion of the material, the bent and unbent bristles pressing the material against the coating or transfer roller to an extent sufficient to achieve uniform application of an ink or coating from the coating or transfer roller on a top surface of the material opposite the irregularly shaped and flat surface portions being supported by the bristles; and (b) printing or roll coating onto the material while being so supported.

2. The method of claim 1 wherein the brush mechanism includes a rotatable cylindrical member having the plurality of bristles radiating therefrom, said bristles characterized by a diameter, length and spacing adapted to stably support the irregularly shaped surface of the material.

3. In a method for printing or roll coating a panel having one or more contoured surfaces with a coating or transfer roller, at least one contoured surface having a portion projecting away from the coating or transfer roller, the improvement comprising the steps of:

(a) supporting the panel under the coating or transfer roller with one or more bristle cylinders characterized by a bristle diameter, length and spacing selected to yield or bend upon contact with the projecting portion of the contoured surface while contacting and supporting the remainder of the panel so as to press the panel against the coating or transfer roller to an extent sufficient to achieve uniform application of an ink or coating from the coating or transfer roller on a top surface of the material opposite the projecting portion of the contoured surface being supported by the bristles; and (b) printing or roll coating onto the panel while being so supported.

4. In an apparatus for contact coating material having a surface with at least one irregularly shaped surface portion and a substantially flat surface portion, the apparatus including a contact coating member and a support member mounted on the apparatus, the support member being rotatable about an axis spaced below the material being coated and perpendicular to a direction of travel of the material through the apparatus, at least a portion of the irregularly shaped surface portion projecting toward the support member, the improvement wherein said support member comprises a plurality of flexible bristles directed radially from the axis, the diameter, length and spacing of the bristles being selected to form a brush which yields or bends upon contact with the projecting portion of the irregularly shaped surface portion while unbent bristles contact and support the flat surface portion of the material, the bent and unbent bristles supporting the material under the coating or transfer roller and pressing the material thereagainst to an extent sufficient to achieve uniform application of an ink or coating from the contact coating member on a top surface of the material opposite the flat and projecting surface portions being supported by the bristles.

5. The apparatus of claim 4 wherein the support member comprises a rotatable cylindrical portion with said bristles fixed to said portion.

6. The apparatus of claim 4 wherein said bristles form a brush having a cylindrical surface in spaced relation to the contact coating member.

7. In an apparatus for coating a panel having a contoured surface comprising a contact coating or transfer roller, the contoured surface having a portion projecting away from the contact coating or transfer roller, the improvement comprising a support mechanism having a plurality of flexible bristles radiating therefrom, said bristles having a diameter, length and spacing selected to form a brush which yields or bends upon contact with the projecting portion of the contoured surface of the panel while contacting and supporting the remainder of the panel so as to support the panel under the contact coating or transfer roller and press the panel thereagainst to an extent sufficient to achieve uniform application of an ink or coating from the contact coating or transfer roller on a top surface of the panel opposite the contoured surface being supported by the bristles.

8. The apparatus of claim 7 wherein said support mechanism comprises a rotatable cylindrical member with said bristles fixed to said member.

9. The apparatus of claim 7 wherein said bristles form a brush having a surface in spaced relation to the contact coating roller.

10. An apparatus for coating a panel having a surface with at least one projecting surface portion and a substantially flat surface portion, the apparatus comprising:

(a) means for contact coating the panel; and (b) a support mechanism located below said means, in spaced relation thereto and comprising a rotatable cylindrical member having flexible bristles radiating therefrom, said bristles having a diameter, length and spacing selected to form a brush which yields or bends upon contact with the projecting portion of the panel while supporting the flat surface portion of the panel so as to support the panel under the contact coating means and press the panel thereagainst to an extent sufficient to achieve uniform application of an ink or coating from the contact coating means on a top surface of the panel opposite the flat and projecting surface portions being supported by the bristles.

11. The apparatus of claim 10 wherein said means for contact coating the panel is a contact coating roller.

12. The apparatus of claim 11 wherein said brush has a surface in spaced relation to the contact coating roller.

* * * * *